US008368320B2

(12) United States Patent
Kuang et al.

(10) Patent No.: US 8,368,320 B2
(45) Date of Patent: Feb. 5, 2013

(54) COLD CATHODE FLUORESCENT LAMP DRIVING CIRCUITS AND ASSOCIATED METHODS OF CONTROL

(75) Inventors: Naixing Kuang, Hangzhou (CN); Lei Du, Hangzhou (CN); Yuancheng Ren, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 242 days.

(21) Appl. No.: 12/882,810

(22) Filed: Sep. 15, 2010

(65) Prior Publication Data

US 2011/0062894 A1 Mar. 17, 2011

(30) Foreign Application Priority Data

Sep. 15, 2009 (CN) ..... 2009 1 0307053

(51) Int. Cl.
*G05F 1/00* (2006.01)

(52) U.S. Cl. ..... 315/291; 315/307; 315/224; 315/185 S; 315/209 R

(58) Field of Classification Search ..... 315/185 S, 315/149–159, 200 A, 224, 247, 291, 307–312
See application file for complete search history.

(56) References Cited

U.S. PATENT DOCUMENTS

2006/0226794 A1* 10/2006 Takahashi et al. ..... 315/308

* cited by examiner

*Primary Examiner* — Tuyet Thi Vo
(74) *Attorney, Agent, or Firm* — Perkins Coie LLP

(57) ABSTRACT

Methods and circuits for CCFL driving circuit control are disclosed according to various embodiments of the present disclosure. In certain embodiments, the methods and circuits for CCFL driving circuit control provide a control signal for regulating both the duty ratio and frequency of the switching control signal that controls the CCFL driving circuit. External components for control loop compensation and frequency sweeping rate, and/or striking frequency setting may also be utilized.

24 Claims, 3 Drawing Sheets

COLD CATHODE FLUORESCENT LAMP DRIVING CIRCUITS AND ASSOCIATED METHODS OF CONTROL

CROSS-REFERENCE TO RELATED APPLICATIONS

This application claims priority to and the benefit of Chinese Patent Application No. 200910307053.7, filed Sep. 15, 2009, which is incorporated herein by reference in its entirety.

TECHNICAL FIELD

The present technology relates generally to driving circuits for controlling discharge lamps, and in particular, relates to driving circuits for controlling cold cathode fluorescent lamps ("CCFL") and associated methods.

BACKGROUND

Discharge lamps, such as CCFL, are widely used as backlight in various electronic devices. Inverter circuits that convert relatively low DC voltages into high frequency AC voltages are generally required for driving discharge lamps. In addition, during an ignition process, a striking voltage of about three times of that in normal operation condition is needed to ignite discharge lamps. Therefore, a control circuit is often needed for regulating the inverter circuit to provide stable AC voltages during normal operation and high voltages during the ignition process.

The control circuit often regulates a duty ratio of a switching signal while maintaining the switching frequency at a constant working frequency so that the inverter outputs a stable AC voltage to drive a discharge lamp under normal operation conditions. During ignition processes or under fault conditions (e.g., open or short lamp conditions), the control circuit sweeps the switching frequency high until a striking frequency is reached so that the inverter outputs a higher AC voltage (commonly referred to as a striking voltage) to get the discharge lamp ignited.

Typically, the control circuit provides separate control signals for regulating the duty ratio of the switching signal and the switching frequency of the inverter, respectively. FIG. 1 is a block diagram illustrating a prior art control circuit 100 for a CCFL inverter. As shown in FIG. 1, the control circuit 100 includes a feedback network 101 for detecting a lamp current or a lamp voltage and generating a feedback signal; a duty control signal generator 103 for receiving the feedback signal and generating a duty control signal based on the feedback signal; a frequency control signal generator 105 for detecting the operation status of the lamp and generating a frequency control signal when the lamp is in ignition or in fault; a duty control module 107 for receiving the duty control signal and generating a duty signal regulated by the duty control signal; a frequency control module 109 for receiving the frequency control signal, generating a frequency signal with a constant frequency when the lamp is in normal operation, and sweeping the frequency of the frequency signal high to a striking frequency when the lamp is in ignition or in fault; a driving module 111 for receiving the duty signal and the frequency signal and generating a switching control signal to drive the switching devices of the lamp inverter in ON and OFF states so that the lamp inverter provides appropriate driving voltage to the lamp.

As a result, the prior art control circuit 100 requires a large number of electrical elements for implementing the various circuitry. Further, when the integrated circuit chip is packaged, separate pins are needed for external connections to realize the control loop compensation, the frequency sweeping rate, and striking frequency setting.

DETAILED DESCRIPTION

Various embodiments of control circuits for regulating discharge lamp driving circuits and associated methods are described below. In the following description, certain specific details, example circuits, and example values are included to provide a thorough understanding of embodiments of the technology. A person skilled in the relevant art will also understand that the technology may have additional embodiments, and that the technology may be practiced without several of the details of the embodiments described below with reference to FIGS. 2-5.

According to several embodiments of the present technology, a control signal is provided for regulating both the duty ratio and frequency of a switching signal for controlling a CCFL driving circuit. Several embodiments of the present technology also allow the use of external components for control loop compensation, frequency sweeping rate, striking frequency setting, and/or other operating parameters. As such, several embodiments of the present technology not only simplify the circuit design and reduce the number of electrical elements but can also save external connections needed in chip packaging. As a result, several embodiments of the present technology for CCFL driving circuit control can be implemented as integrated circuits with low cost and low complexity.

Figure 1:
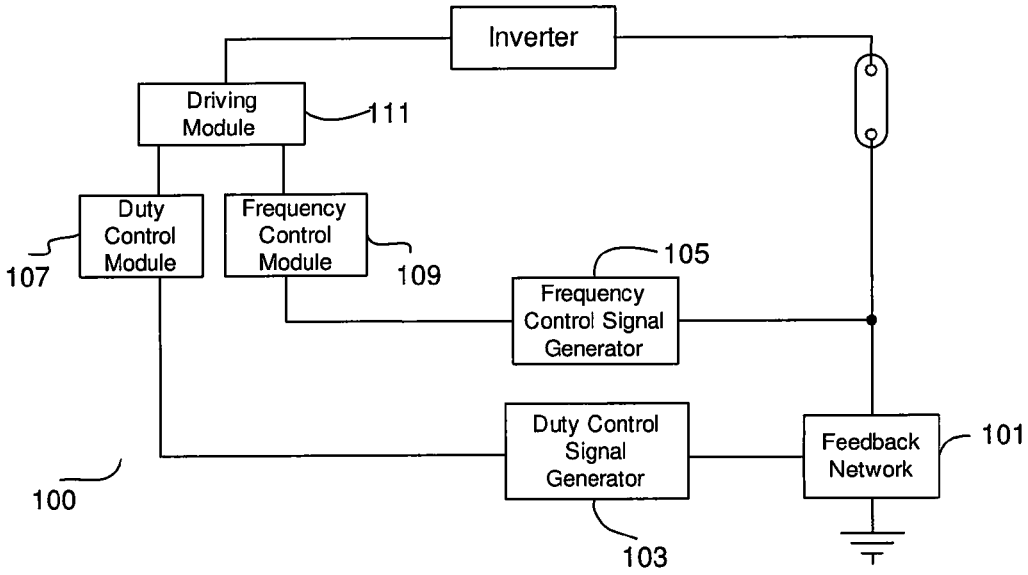
FIG. 1 is a block diagram of a prior art control circuit for a CCFL inverter.
Figure 2:
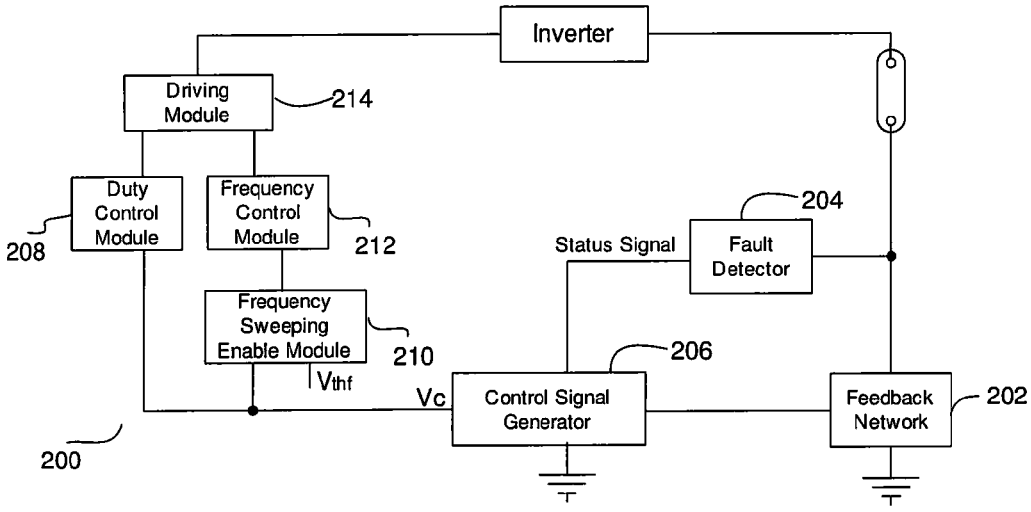
FIG. 2 is a block diagram of a control circuit for a CCFL drive circuit according to embodiments of the present technology.

FIG. 2 is a block diagram of a control circuit 200 for controlling a driving circuit of a CCFL in accordance with embodiments of the present technology. The driving circuit includes switching devices configured to be driven in ON and OFF states for converting a DC voltage into an AC voltage for driving the CCFL. In the illustrated embodiment, the driving circuit is implemented using an inverter. However, other suitable driving circuits for driving discharge lamps may also be used.

Control circuit 200 is configured to generate a switching control signal which drives the switching devices of the driving circuit so that the driving circuit converts a DC voltage into an AC voltage suitable for driving the CCFL. In certain embodiments, the control circuit 200 can include a feedback network 202, a fault detector 204, a control signal generator 206, a duty control module 208, a frequency sweeping enable module 210, a frequency control module 212, and a driving module 214. The input terminals of the feedback network 202 and the fault detector 204 are coupled to the CCFL, and their output terminals are coupled to the control signal generator 206. The output terminal of the control signal generator 206 is coupled to respectively an input terminal of the duty control module 208 and an input terminal of the frequency sweeping enable module 210. The frequency sweeping enable module 210 is configured to receive a frequency sweeping threshold $V_{thf}$ at another input terminal, and couples to the frequency control module 212 at its output terminal. The output terminals of the duty control module 208 and the frequency control module 212 are coupled to the driving module 214.

In operation, the feedback network 202 senses the lamp current or lamp voltage of the CCFL and provides a feedback signal. The fault detector 204 detects the operation status of the CCFL and provides a status signal. The control signal generator 206 processes the feedback signal and the status signal to generate a control signal. The duty control module 208 receives the control signal and provides a duty control signal for regulating the duty ratio of a switching control signal output from the control circuit 200. The frequency sweeping enable module 210 receives the control signal, compares the received control signal with a frequency sweeping threshold $V_{thf}$, and couples/decouples the control signal to/from the frequency control module 212 according to the comparison. The frequency control module 212 is configured to generate a frequency signal which determines the frequency of the switching control signal of the control circuit 200. And the driving module 214 is configured to receive the duty control signal and the frequency control signal to generate the switching control signal of the control circuit 200.

In normal operation, the fault detector 204 has no fault conditions detected and the status signal is low. The control signal generator 206 processes the status signal and the feedback signal so that the control signal generated is regulated by the feedback signal. The voltage of the control signal $V_C$ is clamped between a minimum control value and a maximum control value.

When fault conditions occur or the CCFL is in ignition, the fault detector 204 detects the fault conditions and changes the status signal to high. In response, the control signal generator 206 increases the control signal until a predetermined control voltage is reached. The predetermined control voltage can be larger than the maximum control value and can be larger than the frequency sweeping threshold $V_{thf}$. The duty control module 208 generates a duty signal in response to the control signal. In normal operation, the duty signal varies in a range between a minimum duty value and a maximum duty value. Under fault conditions or in ignition, the duty signal remains at the maximum duty value.

The control signal is provided to the frequency sweeping enable module 210 and is compared to the frequency sweeping threshold $V_{thf}$. If the control signal is larger than the frequency sweeping threshold $V_{thf}$, an enable status is indicated to enable the frequency sweeping module 210 to couple the control signal to the frequency control module 212. If the control signal is smaller than the frequency sweeping threshold $V_{thf}$, a disable status is indicated so that the control signal is decoupled from the frequency control module 212.

In the illustrated embodiment, the frequency sweeping threshold $V_{thf}$ is set to be larger than the maximum control value. Thus, in normal operation, the frequency sweeping module 210 is disabled and consequently the control signal is decoupled from the frequency control module 212. Thus, the frequency control module 212 is not regulated by the control signal and can provide a frequency signal with a constant frequency value. Under fault conditions or in ignition, the control signal increases. When the control signal reaches the frequency sweeping threshold $V_{thf}$, the frequency sweeping enable module 210 is enabled, and the control signal is coupled to the frequency control module 212. The control signal regulates the frequency control module 212 to sweep the frequency of the frequency signal high to a striking frequency value with a predetermined sweeping rate.

Figure 3:
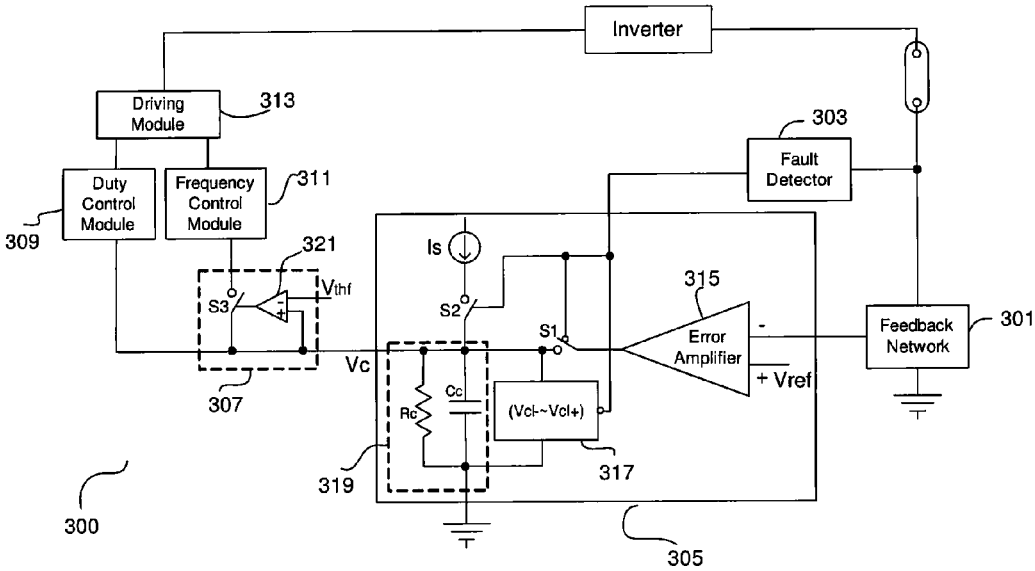
FIG. 3 is a block diagram of a control circuit for a CCFL drive circuit according to additional embodiments of the present technology.

FIG. 3 illustrates a control circuit 300 for controlling a driving circuit of a CCFL in accordance with additional embodiments of the present technology. Even though the control circuit 300 is implemented with particular components in FIG. 3, in other embodiments, the control circuit 300 may also have other suitable implementations.

As shown in FIG. 3, the control circuit 300 includes a control signal generator 305 having an error amplifier 315, a clamping circuit 317, a first switching device S1, a current source Is, a second switching device S2, and a compensation network 319. The first and second switching devices S1 and S2 can include BJTs, MOSFETs, IGBTs, and/or other suitable switching devices. An inverting input terminal of the error amplifier 315 is coupled to a feedback network 301, and a non-inverting input terminal of the error amplifier 315 is coupled to a reference voltage Vref. An output terminal of the error amplifier 315 is coupled to the clamping circuit 317 via the first switching device S1, to the compensation network 319, and to one end of the second switching device S2. The other end of the switching device S2 is coupled to the current source Is. Control terminals of the first and second switching devices S1 and S2 as well as an enable terminal of the clamping circuit 317 are coupled to an output terminal of fault detector 303.

The control circuit 300 includes a frequency sweeping control module 307 having a comparator 321 and a third switching device S3. The third switching device S3 can include BJT, MOSFET, IGBT, and/or other suitable switching devices. A non-inverting input terminal of comparator 321 is coupled to the output terminal of the control signal generator 305, and an inverting input terminal of comparator 321 is coupled to a frequency sweeping threshold $V_{thf}$. An output terminal of comparator 321 is coupled to a control terminal of the third switching device S3. One end of the third switching device S3 is coupled to the output terminal of the control signal generator 305, and the other end of the third switching device S3 is coupled to an input terminal of frequency control module 311.

Figure 4:
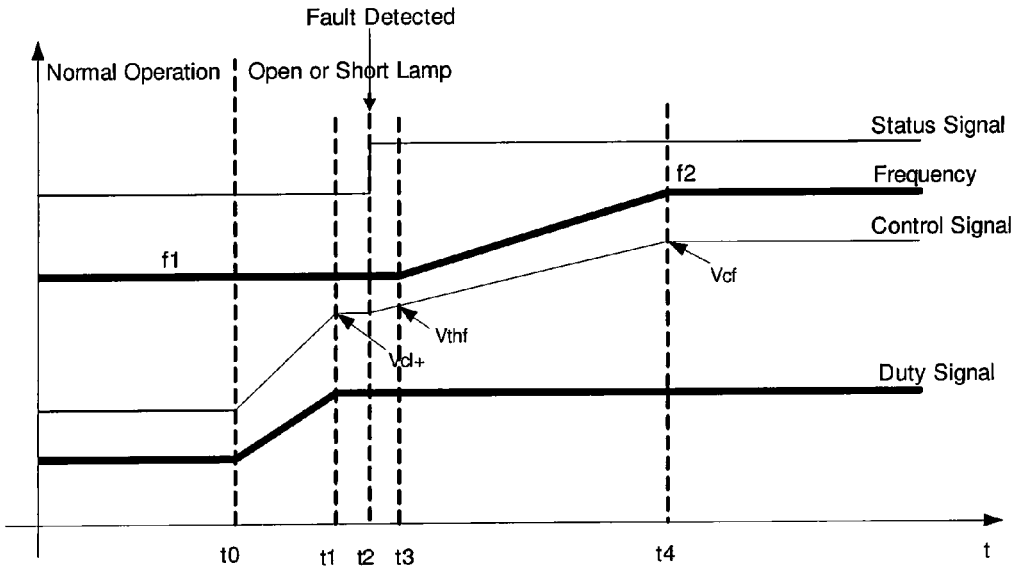
FIG. 4 is an operation waveform diagram of the control circuit shown in FIG. 3 when switching from normal operation to fault conditions.
Figure 5:
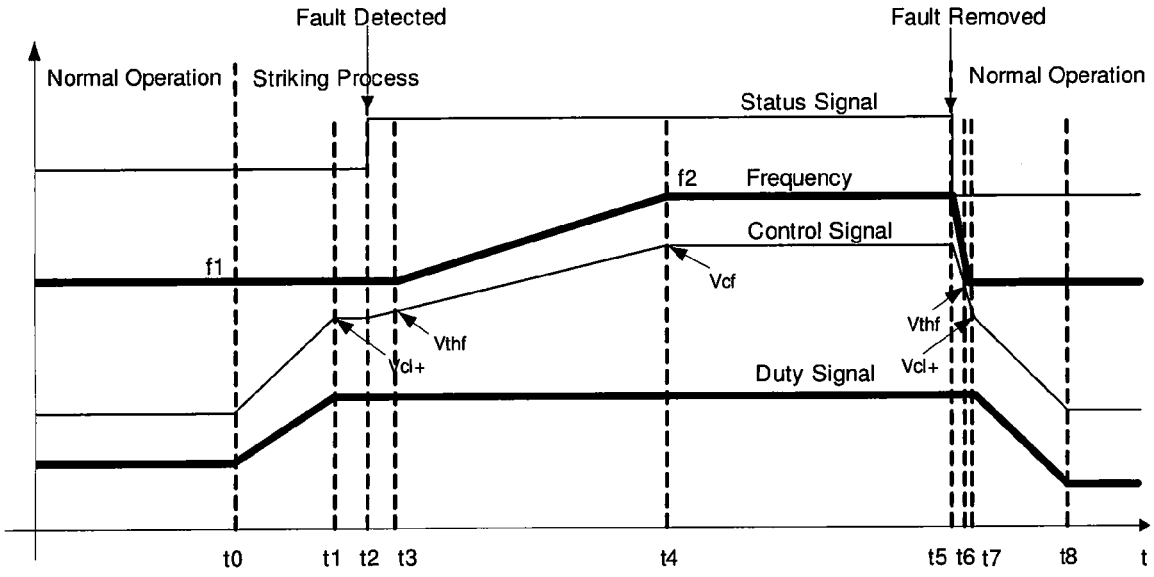
FIG. 5 is an operation waveform diagram of the control circuit shown in FIG. 3 when switching from normal operation to ignition.

Working principles of the control circuit 300 are described below with reference to FIG. 4 and FIG. 5. FIG. 4 and FIG. 5 respectively illustrate an operation waveform of the control circuit 300 when switching from normal operation to a fault condition, and to ignition, respectively. The operation waveforms of a main signal (e.g., a status signal), a control signal, a duty signal, and a frequency of a frequency signal of the control circuit 300 in normal operation are illustrated in FIG. 4 and FIG. 5 as before time t0.

In normal operation, the error amplifier 315 compares a feedback signal from the feedback network 301 to the reference voltage Vref and generates an error signal. The fault detector 303 has no fault conditions detected and outputs a status signal in a low level. As a result, the first switching device S1 is turned off, and the second switching device S2 is turned on with the clamping circuit 317 enabled. The error signal is coupled to the clamping circuit 317 and the compensation network 319 via the first switching device S1. Therefore, the error signal is clamped by the clamping circuit 317 and can only vary between a minimum control value Vcl− and a maximum control value Vcl+.

The control signal generator 305 provides the clamped error signal to the duty control module 309, which in turn outputs a duty signal varying between a minimum duty value and a maximum duty value based on the control signal. The control signal is also provided to the frequency sweeping enable module 307 and compared to the frequency sweeping threshold $V_{thf}$. In certain embodiments, the frequency sweeping threshold $V_{thf}$ is set larger than the maximum control value Vcl+. Thus, a comparison signal in a low level is provided from the comparator 321 in normal operation to off turn the third switching device S3 and thus decouple the control signal from frequency control module 311. Therefore, the frequency control module 311 is not regulated by the control signal and outputs a frequency signal with a constant frequency value f1 in normal operation.

At time t0, a fault condition occurs or the CCFL is entering into ignition. However, the fault detector 303 has not yet detected such conditions because of delay and/or other factors. As a result, the status signal is still in a low level; however, the feedback signal provided by feedback network 301 decreases, resulting in the error signal, namely, the control signal $V_C$ increasing until at time t1 it reaches the maximum control value Vcl+. Correspondingly, the duty signal obtained from the duty control module 309 increases from time t0 until reaching the maximum duty value at time t1. Thereafter, the control signal is clamped at Vcl+ by the clamping circuit 317 until at time t2 the fault detector 303 detects the fault condition and changes the status signal to a high level. In response, the first switching device S1 is turned off, the second switching device S2 is turned on, and the clamping circuit 317 is disabled. Thus at time t2, the error signal is decoupled from the clamping circuit 317 and the compensation network 319, while the current source Is is coupled to the compensation network 319, resulting in the control signal $V_C$ increasing again until at time t3 it reaches the frequency sweeping threshold $V_{thf}$.

As a result, before time t3, because the control signal remains smaller than the frequency sweeping threshold $V_{thf}$, the comparison signal from the comparator 321 remains in a low level, which keeps the third switching device S3 off, and thus keeps the control signal decoupled from the frequency control module 311. Thus, the frequency signal from the frequency control module 311 remains at a constant frequency value f1. At time t3, because the control signal $V_C$ reaches the frequency sweeping threshold Vthf, the comparison signal from the comparator 321 changes to a high level. In response, the third switching device S3 is turned on, resulting in the control signal being coupled to and regulating the frequency control module 311 to sweep the frequency high. At time t4, the compensation network 319 is charged up to saturation, causing the control signal $V_C$ to have a final control value $V_{Cf}$. Consequently, at time t4, the frequency signal is swept to a striking frequency f2 by the frequency control module 311 regulated by the control signal $V_C$. The driving module 313 receives the duty signal and the frequency signal and generates a switching control signal for controlling the driving circuit to provide an output voltage for driving the CCFL.

Because the striking frequency and the frequency sweeping rate are respectively determined by the final control value $V_{Cf}$ and the rate at which the control signal reaches the final control value $V_{Cf}$, and the final control value $V_{Cf}$ and the rate at which the control signal reaches the final control value $V_{Cf}$ are further set by the compensation network 319. Thus, in certain embodiments, the striking frequency and the frequency sweeping rate may be set by properly choosing the compensation network 319. In one embodiment, the compensation network 319 comprises a compensation resistor Rc and a compensation capacitor Cc coupled in parallel. Thus, the final control value $V_{Cf}$ may be adjusted by varying the resistance of the compensation resistor Rc for setting the striking frequency f2. Varying the capacitance of the compensation capacitor Cc can adjust the rate of the control signal reaching the final control value for setting the frequency sweeping rate.

After time t4, the driving circuit of the CCFL is regulated by the control signal operating with the maximum duty value and the striking frequency f2. Thus, the CCFL is driven by a striking voltage. If a reasonably long time period has expired but the CCFL has not been ignited, the system may be shut down. Otherwise, if the CCFL is ignited after a time period, for example, at time t5 as illustrated in FIG. 5, the fault detector 303 determines that fault conditions are removed and changes the status signal to a low level. In response, the first switching device S1 is turned on, the second switching device S2 is turned off, and the clamping circuit 317 is enabled. The error amplifier is coupled again at its output terminal to the clamping circuit 317 and to the compensation network 319 while the current source Is is decoupled from the compensation network 319. Thus, the control signal $V_C$ decreases because of the discharging of the compensation network 319, and the frequency signal decreases.

At time t6, the control signal $V_C$ is decreased to be lower than the frequency sweeping threshold $V_{thf}$. The frequency signal is restored to the constant frequency f1 as in normal operation. Meanwhile, the comparison signal of the comparator 321 is changed to a low level. In response, the third switching device S3 is turned off and consequently decouples the control signal from the frequency control module 311. As a result, the frequency signal remains at the constant frequency f1.

From time t6 to time t7, the control signal continues decreasing until at time t7 it reaches the maximum control value Vcl+ at the clamping circuit 317. Therefore, from time t5 to time t7, the duty signal output from the duty control module 309 remains at the maximum duty value. After time t7, the control signal is again determined by the error signal of error amplifier 315, and the duty control module consequently varies the duty signal in response to the control signal. At time t8, the whole system restores to a normal and stable operation status.

According to several embodiments of the present technology, the comparison signal from the comparator 321 may be in a low level when the control signal is larger than the frequency sweeping threshold $V_{thf}$ and in a high level when the control signal is smaller than the frequency sweeping threshold $V_{thf}$. The inverting and non-inverting input terminals of the comparator 321 are coupled to the output terminal of the error amplifier 305 and the frequency sweeping threshold $V_{thf}$, respectively.

Several embodiments of the present technology provide a control signal for regulating both the duty ratio and frequency of the switching control signal that drives the switching devices of the CCFL driving circuit. Accordingly, circuit complexity and the fabricating cost of the control circuits may be greatly reduced when compared to conventional devices. Also, several embodiments of the technology may require less number of external connections than conventional devices because the control loop compensation, frequency sweeping rate, and striking frequency setting may be implemented by sharing the same external components, such as the compensation network 319 in FIG. 3.

From the foregoing, it will be appreciated that specific embodiments of the technology have been described herein for purposes of illustration, but that various modifications may be made without deviating from the disclosure. Many of the elements of one embodiment may be combined with other embodiments in addition to or in lieu of the elements of the other embodiments. Accordingly, the disclosure is not limited except as by the appended claims.

We claim:

1. A method for controlling a driving circuit of a cold cathode fluorescent lamp (CCFL), comprising:

sensing a lamp current or a lamp voltage of the CCFL to provide a feedback signal;

detecting an operation status of the CCFL and providing a status signal;

processing the feedback signal and the status signal to generate a control signal;

comparing the control signal with a frequency sweeping threshold to generate a comparison signal;

according to the comparison signal, selectively applying the control signal to regulate a duty ratio or a frequency of a switching control signal that controls the driving circuit;

wherein the status signal comprises a first logic state representing that the CCFL is in normal operation and a second logic state representing that the CCFL is in a fault condition or in ignition; and wherein the control signal is regulated by the feedback signal and is clamped between a minimum control value and a maximum control value when the status signal is in the first logic state, and is increased to a predetermined final control value when the status signal is in the second logic state.

2. The method of claim 1, wherein processing the status signal and the feedback signal comprises:

comparing the feedback signal with a reference signal to generate an error signal;

coupling the error signal to the control signal and clamping the control signal between a minimum control value and a maximum control value when the status signal is in the first logic state; and decoupling the error signal from the control signal and increasing the control signal to a predetermined final control value when the status signal is in the second logic state.

3. The method of claim 1, wherein processing the status signal and the feedback signal comprises:

comparing the feedback signal with a reference voltage by an error amplifier to provide an error signal; and feeding the status signal and the error signal to a circuit comprising a first switching device, a clamping circuit, a compensation network, a current source and a second switching device so that:

when the status signal is in the first logic state, the first switching device is turned on to couple the error signal to the clamping circuit and to the compensation network, the clamping circuit is enabled to clamp the error signal between the minimum control value and the maximum control value, and the second switching device is turned off to decouple the current source from the compensation network; the error signal is provided as the control signal; and when the status signal is in the second logic state, the first switching device is turned off to decouple the error signal from the clamping circuit and the compensation network, the clamping circuit is disabled, and the second switching device is turned on to couple the current source to the compensation network; the compensation network is charged by the current source, causing the control signal increasing to a predetermined final control value.

4. The method of claim 3, wherein the first and second switching devices individually include at least one of a bipolar junction transistor, a metal oxide semiconductor field-effect transistor, and an insulated gate bipolar transistor.

5. The method of claim 3, wherein the compensation network comprises a compensation resistor and a compensation capacitor in parallel.

6. The method of claim 3, wherein the control signal reaches the final control value when the compensation network is charged to saturation, and wherein a rate of increase of the control signal is determined by a charging rate of the compensation network.

7. The method of claim 1, wherein the maximum control value is smaller than the frequency sweeping threshold.

8. The method of claim 1, wherein the final control value is larger than the frequency sweeping threshold.

9. The method of claim 1, wherein the comparison signal is in an enable state when the control signal is larger than the frequency sweeping threshold, and is in a disable state when the control signal is smaller than the frequency sweeping threshold.

10. The method of claim 9, wherein the enable and disable states are respectively represented by two different logic values.

11. The method of claim 9, wherein when the comparison signal is in the disable state, the control signal only regulates the duty ratio of the switching control signal, and wherein when the comparison signal is in the enable state, the control signal regulates the frequency of the switching control signal to be swept high while keeping the duty ratio of the switching control signal at a maximum duty value.

12. The method of claim 11, wherein the control signal further determines a frequency sweeping rate at which the frequency is swept to a striking frequency.

13. The method of claim 9, wherein when the comparison signal is in the enable state, the control signal is coupled to a frequency control module and regulates the frequency control module to sweep the frequency of the switching control signal high, and wherein when the comparison signal is in the disable state, the control signal is decoupled from the frequency control module which keeps the frequency of the switching control signal at a constant value.

14. The method of claim 12, wherein the control signal is coupled to or decoupled from the frequency control module via a third switching device, and wherein the third switching device is turned on when the comparison signal is in the enable state, and is turned off when the comparison signal is in the disable state.

15. A circuit for controlling a driving circuit of a cold cathode fluorescent lamp (CCFL), comprising:

a feedback network configured to sense a lamp current or a lamp voltage of the CCFL and to provide a feedback signal;

a fault detector configured to detect an operation status of the CCFL and providing a status signal;

a control signal generator configured to receive and process the status signal and the feedback signal to provide a control signal;

a duty control module configured to receive the control signal and to generate a duty signal;

a frequency control module configured to provide a frequency signal;

a frequency sweeping enable module configured to receive and compare the control signal with a frequency sweeping threshold to generate a comparison signal, and to couple or decouple the control signal to or from the frequency control module according to the comparison signal; and a driving module configured to receive the duty signal and the frequency signal to generate a switching control signal for controlling power switches of the driving circuit.

16. The circuit of claim 15, wherein the status signal comprises a first logic state representing that the CCFL is in normal operation and a second logic state representing that the CCFL is in a fault condition or in ignition.

17. The circuit of claim 16, wherein the control signal is regulated by the feedback signal and is clamped between a minimum control value and a maximum control value when the status signal is in the first logic state, and is increased to a predetermined final control value when the status signal is in the second logic state.

18. The circuit of claim 15, wherein the control signal generator comprises an error amplifier, a first switching device, a clamping circuit, a compensation network, a second switching device, and a current source, wherein the error amplifier is configured to receive the feedback signal and compare the received feedback signal with a reference signal to provide an error signal;

the first switching device is configured to receive the status signal at a control terminal and is configured to be turned on when the CCFL is in normal operation to couple the error signal to the clamping circuit and to the compensation circuit, and thereby providing the error signal as the control signal, and is further configured to be turned off when the CCFL is in a fault condition or in ignition to decouple the error signal from the clamping circuit and the compensation circuit;

the clamping circuit is configured to receive the status signal and is configured to be enabled when the CCFL is in normal operation to clamp the control signal between a minimum control value and a maximum control value, and is further configured to be disabled when the CCFL is in a fault condition or in ignition;

the second switching device is configured to receive the status signal at a control terminal, and is configured to be turned off when the CCFL is in normal operation to decouple the current source from the compensation circuit, and is further configured to be turned on when the CCFL is in a fault condition or in ignition to couple the current source to the compensation circuit;

the compensation network is configured to compensate the error amplifier when the CCFL is in normal operation, and is further configured to be charged by the current source when the CCFL is in a fault condition or in ignition, causing the control signal to increase to a final control value; and the current source is configured to charge the compensation network when the CCFL is in a fault condition or in ignition.

19. The circuit of claim 18, wherein the compensation network comprises a compensation resistor and a compensation capacitor in parallel.

20. The circuit of claim 18, wherein the control signal reaches the final control value when the compensation network is charged to saturation, and wherein a rate of increase of the control signal is determined by a charging rate of the compensation network.

21. The circuit of claim 18, wherein the maximum control value is smaller than the frequency sweeping threshold.

22. The circuit of claim 18, wherein the final control value is larger than the frequency sweeping threshold.

23. The circuit of claim 15, wherein the frequency sweeping enable module comprises a comparator and a third switching device, wherein the comparator is configured to receive the control signal and compares received control signal with the frequency sweeping threshold to output the comparison signal;

when the control signal is larger than the frequency sweeping threshold, the comparison signal is in an enable state;

when the control signal is smaller than the frequency sweeping threshold, the comparison signal is in a disable state;

the third switching device is configured to receive the comparison signal at a control terminal, and is configured to be turned on when the comparison signal is in the enable state to couple the control signal to the frequency control module so that the frequency control module is regulated by the control signal to sweep the frequency high; and the third switching device is further configured to be turned off when the comparison signal is in the disable state to decouple the control signal from the frequency control module.

24. The circuit of claim 23, wherein the enable and disable states of the comparison signal are respectively represented by two different logic values.

* * * * *